US006107931A

United States Patent [19]

Nicholson

[11] Patent Number: 6,107,931

[45] **Date of Patent: *Aug. 22, 2000**

[54] ACCESS SYSTEMS AND METHODS OF IDENTIFYING AN AUTHENTIC KEY

[76] Inventor: James A. Nicholson, 4255 CR 838 NW., Havre, Mont. 59501

[ * ] Notice: This patent issued on a continued prosecution application filed under 37 CFR 1.53(d), and is subject to the twenty year patent term provisions of 35 U.S.C. 154(a)(2).

[21] Appl. No.: 08/759,191

[22] Filed: Dec. 4, 1996

[51] Int. Cl.[7] ..... E05B 47/00

[52] U.S. Cl. ..... 340/825.31; 235/380; 235/454; 235/491

[58] Field of Search ..... 340/825.31, 825.34; 235/380, 382, 382.5, 454, 491, 465, 470; 250/484.4, 556, 581, 271, 222.1; 382/116

[56] References Cited

U.S. PATENT DOCUMENTS

| | | | |
|---|---|---|---|
| 3,662,181 | 5/1972 | Hercher et al. | 235/465 |
| 4,758,716 | 7/1988 | Mayer et al. | 235/470 |
| 4,783,823 | 11/1988 | Takaki et al. | 382/116 |
| 4,868,559 | 9/1989 | Pinnow | 340/825.31 |
| 4,900,907 | 2/1990 | Matusima et al. | 235/472 |
| 4,908,516 | 3/1990 | West | 250/556 |
| 4,928,212 | 5/1990 | Benavides . | |
| 4,970,819 | 11/1990 | Mayhak . | |
| 5,022,175 | 6/1991 | Oncke et al. . | |
| 5,053,930 | 10/1991 | Benavides . | |
| 5,083,392 | 1/1992 | Bookstaber . | |
| 5,168,114 | 12/1992 | Enget . | |
| 5,171,924 | 12/1992 | Honey et al. . | |
| 5,210,411 | 5/1993 | Oshima et al. | 250/271 |
| 5,243,182 | 9/1993 | Murata et al. | 250/222.1 |

*Primary Examiner*—Edwin C. Holloway, III
*Attorney, Agent, or Firm*—Wells, St. John, Roberts, Gregory & Matkin, P.S.

[57] ABSTRACT

The present invention provides for access systems and methods for identifying an authentic key. An embodiment of the access system includes a key having at least one phosphorescent material, the at least one phosphorescent material being operable to emit at least one response photon; a photon receptor coupled with the key, the photon receptor being configured to sample the at least one response photon and generate a representative signal thereof; and a discrimination analyzer coupled with the photon receptor, the discrimination analyzer being operable to generate a control signal responsive to a comparison of the representative signal and a signature code.

22 Claims, 5 Drawing Sheets

ACCESS SYSTEMS AND METHODS OF IDENTIFYING AN AUTHENTIC KEY

TECHNICAL FIELD

The present invention relates to access systems and methods of identifying an authentic key.

BACKGROUND OF THE INVENTION

Certain elements in the periodic table of elements, and compounds of those elements, as well as compounds of other elements that separately do not phosphoresce, exhibit phosphorescence. These materials are notable inasmuch as they absorb electromagnetic energy across a variety of wavelengths, the spectrum of absorption of which being specific to the element/compound. This energy absorption causes some of the atoms within the mass of the material to become excited above their ground state. This atomic excitation is transitory. The excited atoms subsequently re-emit photons as they return to their ground state.

These new photons are emitted at wavelengths that are the same as or (more usually) different from and more uniform than those absorbed during excitation. The excited atoms return to the ground state by emitting electromagnetic energy (photons), conforming to the law of the conservation of energy, over a variable time interval after excitation. Thus, the excited state of the material has a half life. After a given period of time (which varies with the material) one half of the excited atoms will have emitted a characteristic photon in the process of returning to the ground state. This time interval can be extremely short (e.g., the phosphors used in modern color television picture tubes) or very long (e.g., a glow-in-the-dark toy) possibly lasting for an hour or more.

The phosphorescent materials may be combined to form thousands of compositions. The phosphorescent materials and compositions thereof provide thousands of formulations of materials which exhibit unique emission characteristics. In particular, the wavelength and half life emission characteristics of the phosphorescent materials and compositions vary. The unique emission characteristic provides a "signature" of the respective phosphorescent material or composition.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
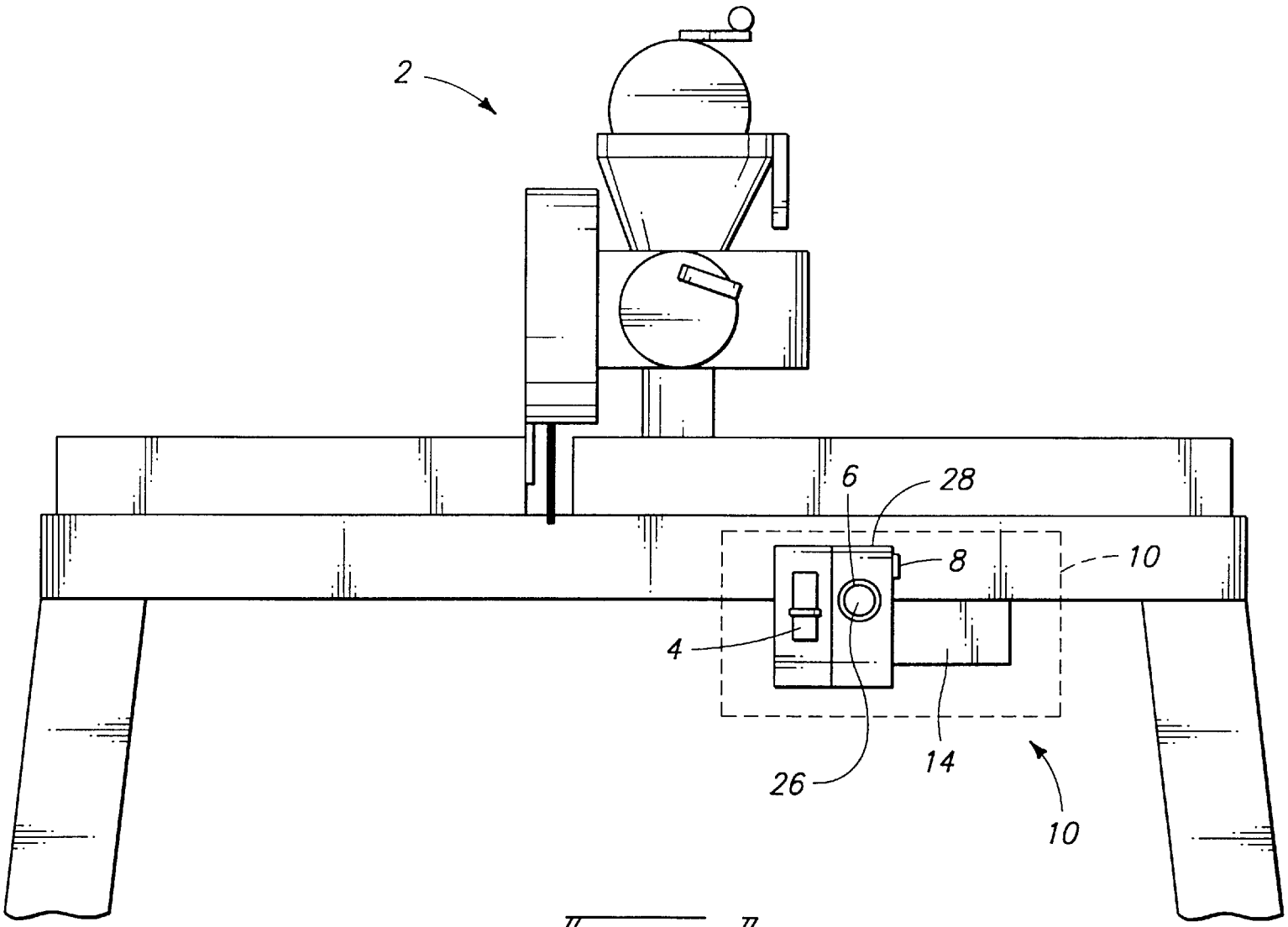
FIG. 1 is a front elevational view of the access system in accordance with the present invention operable to control the access to a radial arm saw.

This disclosure of the invention is submitted in furtherance of the constitutional purposes of the U.S. Patent Laws "to promote the progress of science and useful arts" (Article 1, Section 8).

Overview

In a first aspect of the present invention, an access system operable to identify an authentic key comprises: a key having at least one phosphorescent material, the at least one phosphorescent material being operable to emit at least one response photon; a photon receptor coupled with the key, the photon receptor being configured to sample the at least one response photon and generate a representative signal thereof; and a discrimination analyzer coupled with the photon receptor, the discrimination analyzer being operable to generate a control signal responsive to a comparison of the representative signal and a signature code.

In a second aspect of the present invention, a method of identifying an authentic key comprises the steps of:

a. providing a key having at least one phosphorescent material;

b. emitting at least one response photon;

c. generating a representative signal corresponding to the at least one response photon;

d. comparing the representative signal with a signature code; and e. generating a control signal responsive to the comparison of the representative signal and the code signal.

In an additional aspect of the present invention, a method of identifying an authentic key comprises the steps of:

a. generating a signature code corresponding to the authentic key;

b. storing the signature code;

c. providing a key having at least one phosphorescent material thereon;

d. emitting a plurality of test photons;

e. emitting a plurality of response photons responsive to the emission of the test photons;

f. sampling the response photons;

g. generating a representative signal corresponding to the response photons;

h. comparing the representative signal with the signature code; and i. generating a control signal responsive to the comparison of the representative signal and the signature code.

Access System Generally

A preferred embodiment of the access system and methods for identifying an authentic key in accordance with this invention are described with reference to FIG. 1–FIG. 5. Such figures show various aspects and characteristics described in detail below of the preferred access system and methods for identifying an authentic key. The access system is generally designated with numeral 10.

The access system 10 is useable with any application apparatus 2 for which physical access restriction is desired. For example, the application apparatus 2 may be a table saw in the house, an automobile, gate, gun, house door, computer, or any one of a variety of other items for which security is desired. The access system 10 according to the present invention is useable to provide restricted access to any application apparatus 2 which is unsecured or secured by conventional locks.

The preferred embodiment of the access system 10 according to the present invention preferably utilizes a randomized stored excitation code, and a key 12 including phosphorescent materials forming a phosphorescent composition 20. The access system 10 is operable to randomly sample over time the half life emissions and wavelengths of photons emitted from the phosphorescent composition 20 on the key 12. Even though another party may have a similar key 12, the random pulse code for generating test photons and the random sampling sequence of response photons would not be known thereby providing an access system 10 of increased security. Accordingly, the access system 10 would deny access to an individual presenting a counterfeit key in an attempt to access the application apparatus 2.

The access system 10 in accordance with the present invention records and discriminates coded values of response photons emitted and/or reflected from phosphorescent materials provided on the surface of the keys 12. The purpose of the discrimination is to provide a signal that indicates a match between samples of phosphorescent materials submitted on the keys 12. In general, a plurality of test photons are emitted toward the presented key 12. The presented key 12 emits a plurality of response photons responsive to the reception of test photons. The response photons may be sampled and analyzed for determining whether the presented key is authentic.

Referring to FIG. 1, a table saw 2 is shown equipped with the access system 10 according to the present invention. The table saw 2 has a standard power switch 4 for providing a user with the ability to selectively supply power to the saw 2. In addition, the access system 10 comprises a light interface 28 and discrimination analyzer 14 which are provided adjacent to the power switch 4.

The light interface 28 and discrimination analyzer 14 form a phosphorescent module which may be implemented as a compact sealed unit. In particular, the module may be implemented within a unit having a volume of less than 3 cubic centimeters. Alternatively, the access system 10 according to the present invention may be distributed within the electronics and/or optics of the application apparatus 2.

The light interface 28 includes an input/output window 26 which is preferably transparent to test photons and response photons passing therethrough. The input/output window 26 permits test photons emitted by the photon emitter 22 to exit the light interface 28 and response photons emitted by the presented key 12 to enter therethrough. The input/output window 26 may include a filter for removing light photons outside of a desired wavelength band spread.

The light interface 28 may additionally include a key sensor 6 for detecting the presence of a key 12. An ambient light sensor 8 may be provided within the light interface 28 to generate ambient light condition information. The ambient light information may be forwarded to a central processing unit 30 within the discrimination analyzer 14. The central processing unit 14 may utilize the ambient light information to determine when a key 12 is presented. In particular, the presentation of a key 12 reduces ambient light received by the ambient light sensor 8 and starts the recognition sequence. Other suitable devices for detecting the presence of a key and initiating the recognition sequence may be utilized in the access system 10 according to the present invention.

As described in more detail below, the light interface 28 is configured to emit test photons toward a presented key 12 and receive response photons from the key 12. The response photons are forwarded to the discrimination analyzer 14 for determining whether the presented key 12 is authentic for permitting access to the application apparatus 2.

Responsive to the determination within the discrimination analyzer 14 that the presented key is authentic, the access system 10 permits operation of the application apparatus 2 secured thereby. In particular, the access system 10 is configured to generate a control signal for operating a lock actuator 60 for selectively enabling the application apparatus 2. The lock actuator 60 may comprise a relay for applying operational power to the application apparatus 2. Alternatively, the lock actuator 60 may comprise an electromechanical device such as a solenoid for mechanically enabling the application apparatus 2.

The access system 10 may be configured to output the control signal via a variety of media including mechanical, electrical, electronic (digital and analog), optical, magnetic and others. These control signals may be accessed by appropriate connections including electrical connectors, fiber optic connectors, magnetic switches or hard wired components.

The access system 10 in accordance with the present invention generally includes three components. First, a coded device or key 12 is utilized to identify the properly authorized individual or party who should have access to the application apparatus 2. A light interface 28 is provided to emit test photons towards the subject key 12 and receive response photons therefrom. A discrimination analyzer 14 is provided to "read" the presented key 12 to determine whether the key 12 is authentic and access should be granted. The discrimination analyzer 14 subsequently generates a control signal for operating the lock actuator 60 and locking or unlocking the application apparatus 2.

A power supply (not shown) is provided for providing operational power. Depending upon the application apparatus 2 being secured, the power supply may include an internal battery for providing portable operational power or, alternatively, the power supply may derive power from the application apparatus 2.

The key 12 may be formed as a plastic card, ring wearable on the hand of an individual, or in any configuration permitting photon communication between the light interface 28 and the phosphorescent composition 20 on the key 12. Alternatively, the key 12 may be removably affixed by an adhesive depending upon the specific application.

In the access system 10 according to the present invention, the key 12 shall preferably include a phosphorescent composition 20 of more than at least five phosphorescent elements and compounds rather than a single phosphorescent element or compound. Thus, the key 12 should possess emission characteristics (e.g., wavelength, half life) that are able to be intentionally varied over a suitable range by changing the composition of the phosphorescent materials. The key material can be produced with phosphorescent elements or compounds that vary in a variety of ways.

Regardless of configuration, the key 12 preferably contains a unique composite phosphorescent material on or in proximity to a surface thereof. The phosphorescent composition 20 may alternatively be provided within the key 12 and covered with a transparent protective coating. The protective coating may be Mylar film or other suitable material having good photon transparency properties. The phosphorescent composition 20 includes a unique formulation of phosphorescent materials, and a matrix material or binder to provide a foundation for the phosphors. Providing a first level of security, the phosphors can be mixed from a selection of materials that exhibit a wide variety of photon absorption/emission characteristics. The compounding of the materials for the key 12 provides a large number of phosphor compositions 20 (i.e., at least one million possible combinations of phosphorescent materials may be utilized within the access system 10 according to the present invention). Each specific phosphor composition 20 may be distinguished from other phosphor compositions thereby permitting identification of an authentic key 12 from counterfeit keys. The matrix materials which bind the phosphorescent materials may be interactive, including providing filtering, and altering attenuation and reflectivity of the materials within the phosphorescent composition 20 of the key 12.

The availability of a vast array of phosphorescent compounds, each of which displays a very specific set of photon absorption and emission characteristics, coupled with the ability to mix these specific compounds with each other, and with matrix ingredients that can also modify the spectrum of absorption and emissions provides a potential of over a million distinct keys 12. Further, the use of a randomly generated code in accordance with an embodiment of the present invention for encoding the phosphorescent key 12 provides an additional level of security because the re-emitted response photons display different characteristics based on both the key characteristics, and the characteristics of the test photon sequence with which they were illuminated. In addition, providing a code for sampling the response photons in accordance with an embodiment of the present invention provides an additional security measure. The encoding of the emission of test photons and sampling of response photons is discussed in detail below.

Light Interface

Figure 2:
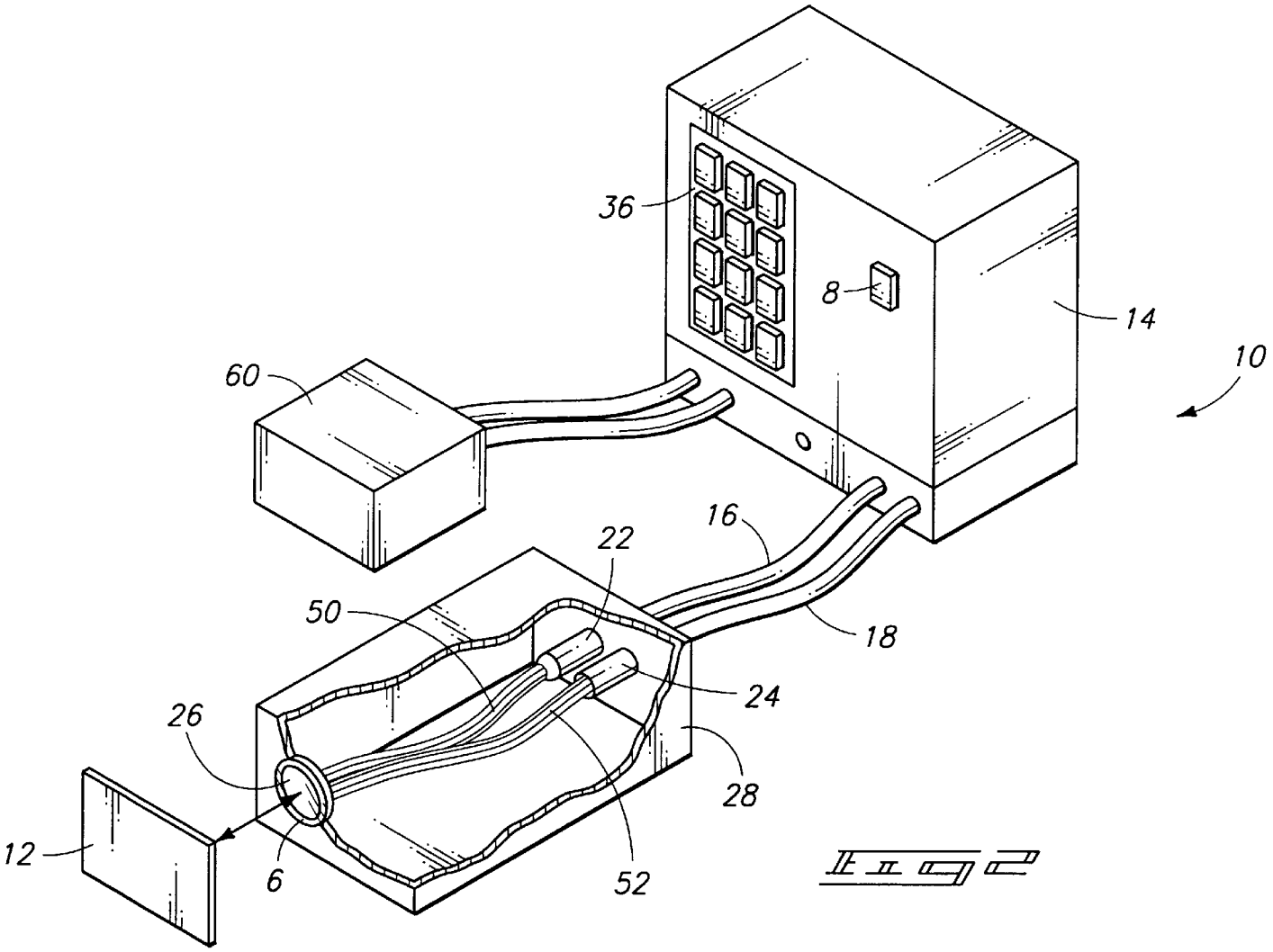
FIG. 2 is an isometric view of an embodiment of the access system in accordance with the present invention.

The light interface 28 of the access system 10 preferably includes a photon emitter 22 and photon receptor 24 as shown in FIG. 2. The photon emitter 22 is operable to generate test photons which are directed toward the key 12 and absorbed by the phosphorescent composition 20 and the phosphorescent materials therein. The photon emitter 22 may comprise an incandescent light, photo diode, laser, florescent lamp or other photon emitting device. The photon emitter 22 may preferably produce test photons having a variety of wavelengths, including those well beyond both ends of the visible spectrum.

For example, a plurality of light emitting diodes may be utilized which individually emit photons at a specific and predetermined wavelength. The test photons emitted from one light emitting diode preferably have a wavelength which differs from the frequency of test photons emitted from an adjacent light emitting diode.

The specific wavelengths are preferably complementary to the absorptive spectrum of the phosphors which comprise the phosphorescent composition 20. The illuminated materials (phosphorescent composition 20) in the key 12 absorb photon (electromagnetic) radiation across a spectrum of energies and wavelengths. The phosphorescent composition 20 re-emit the absorbed energy during and/or after the illumination as a plurality of response photons. The re-emitted photon based energy may be in the same, or different, wavelengths than the illumination spectrum. As mentioned earlier, the matrix materials within the phosphorescent composition 20 may or may not be interactive with the process (e.g., providing filtering and attenuation, and altering reflectivity of the phosphorescent materials).

The response photons pass through the input/output window 26 and fiber optical conduit 52. The photon receptor 24 shown in FIG. 2 receives the response photons emitted from the phosphorescent composition 20 of the key 12. The response photons are sampled over a predetermined period of time (e.g., 0.25 seconds). The photon receptor 24 preferably converts the response photons into an analog voltage signal. The photon receptor 24 may comprise photon receptive materials including gallium arsenide, silicon, selenium, charge coupled devices (CCDs), photon sensitive films, iconscopes and holographic technologies. The voltage signal may be applied to the discrimination analyzer 14 for comparison with a previously stored signature code. Such a comparison will identify the presented key 12 as authentic or counterfeit.

Referring again to FIG. 2, the coupling of the light interface 28 and discrimination analyzer 14 is described below apart from the application apparatus 2. The photon emitter 22 and photon receptor 24 of the light interface 28 are each coupled with respective fiber optical conduits 50, 52. The fiber optical conduits 50, 52 are optically coupled with the input/output window 26. The photon emitter 22 and photon receptor 24 provide respective electrical-to-optical and opticalto-electrical conversions.

Alternatively, the optical conduits 50, 52 may be omitted and the photon emitter 22 and photon receptor 24 may be configured to be optically coupled directly with the phosphorescent composition 20 of the key 12. The input/output window 26 may be provided immediately adjacent the photon emitter 22 and photon receptor 24 in such an embodiment.

The light interface 28 is coupled with the discrimination analyzer 14 via a plurality of electrical cables 16, 18. The respective electrical cables 16, 18 transmit electrical data signals, which correspond to the test photons emitted and response photons received, intermediate the light interface 28 and discrimination analyzer 14.

Discrimination Analyzer

Figure 3:
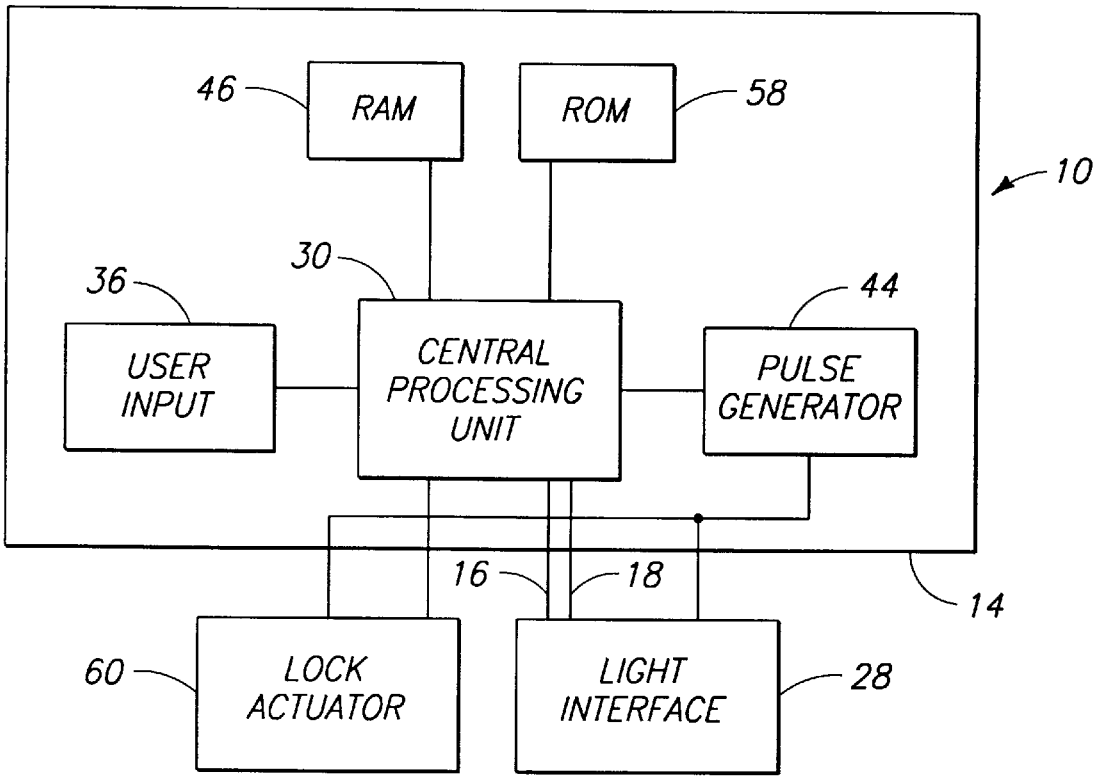
FIG. 3 is a functional block diagram of a discrimination analyzer according to a preferred embodiment of the access system in accordance with the present invention.

A preferred embodiment of the discrimination analyzer 14 is shown in FIG. 3. The discrimination analyzer 14 includes a central processing unit 30 for controlling the operations of the access system 10 according to the present invention. The central processing unit 30 may be a Pentium processor provided by Intel Corporation, or any other suitable processing unit. The central processing unit 30 is preferably coupled with a RAM memory device 46 and ROM memory device 58. The central processing unit 30 may store signature codes, random pulse codes, entry and failure data within the RAM memory device 46. The operational software code and respective access system 10 encoding codes are preferably stored within the ROM memory device 58.

The discrimination analyzer 14 preferably includes a random pulse generator 44. The random pulse generator 44 is configured create a unique code for generating a unique sequence of test photons for illuminating the phosphorescent composition 20 on the key 12. The code may be stored within the RAM memory device 46. In addition, the random pulse generator 44 may generate a second unique code for sampling the response photons emitted from the phosphorescent composition 20 responsive to the emission of the test photons. Providing the unique randomly generated codes provides enhanced security against a counterfeit key having a phosphorescent composition 20 which is similar to the phosphorescent composition 20 of an authentic key 12.

Encoding Process

The encoding process defines an authentic key 12 which may be utilized to access the application apparatus 2. The access system 10 according to the present invention preferably generates a unique "signature" that corresponds to a key 12 presented adjacent to the input/output window 26. Generating a signature code for the key defines an authentic key 12 which may be utilized to access the application apparatus 2 via the access system 10. The signature code is preferably stored as a digital code within the RAM memory device 46 of the discrimination analyzer 14. Alternatively, an additional memory device such as hard disk drive space, magnetic data storage medium or any other conventional data storage device may be utilized. Additionally, the code signature may be stored as a photographic image, bit map, bar code or an analog recording in any form.

The encoding process establishes the signature code for an authentic key 12. The encoding process is generally only utilized when the access system 10 is initially activated or at any subsequent time when the device is "re-keyed".

The access system 10 may be configured such that initial encoding (i.e., the generation of a signature code corresponding to an authentic key for operating the access system 10) is preset before installation and only appropriate keys 12 provided with the access system 10 may be utilized therewith. It follows that such a preset access system 10 offers increased security with reduced flexibility.

Alternatively, the access system 10 may be configured such that a user may engage the encoding procedure subsequent to installation. The user may erase signature codes thereby eliminating the operational capability of the corresponding keys or add additional signature codes which correspond to additional authentic keys which may be utilized to operate the access system 10. Additionally, the access system 10 may be configured to permit the user to alter application specific factors including the degree of matching required between a signature code stored within the RAM memory device 46 and a representative signal generated from a presented key 12 to provide access to the application apparatus 2.

To prevent an unauthorized key from being encoded as an authentic key 12 and able to operate the access system 10, it is preferred that the encoding procedure be confidential. A variety of methods for generating an encoding instruction may be utilized depending upon the application apparatus 2 being locked and the level of security desired.

The access system 10 may initiate the encoding process responsive to the input of an encoding code by a user. In particular, a user may input an encoding instruction or code into the discrimination analyzer 14 via a user interface 36 shown in FIG. 2 and FIG. 3. The entry of the encoding code instructs the discrimination analyzer 14 to operate in an encoding mode of operation. The discrimination analyzer 14 and phosphorescent composition 20 operate to generate a unique signature code which corresponds to an authentic key 12 which may be utilized to operate the access system 10 according to the present invention. This unique signature code is generated during the encoding mode of operation.

Another method of generating the encoding instruction or code includes providing a bar code strip (not shown) having a predefined bar code pattern. Only a user possessing the bar code strip may add or delete signature codes thereby creating new authentic keys 12 or deleting previously operational authentic keys 12.

The user may enter a request instruction via the user interface 36 requesting initiation of the encoding process. Following the reception of the request instruction, the photon emitter 22 may illuminate for a predetermined period of time (e.g., 10 seconds) while the photon receptor 24 simultaneously operates as a bar code reader. The user subsequently wipes the encoded bar code strip across the input/output window 26. The discrimination analyzer 14 reads the encoding provided upon the bar code strip. The bar code signal is converted to an electrical voltage signal via the photon receptor 24. The voltage signal may be subsequently amplified and digitized within the amplifier 56 and analog to digital converter 54.

The central processing unit 30 is operable to compare the digitized representation of the received signal with a corresponding predefined encoding code which may be stored within the ROM memory unit 58 and corresponds to an authentic bar code. The user is granted access to complete the encoding process of the key 12 following a determination that the bar code signal generated by the bar code is a match to the predefined encoding code.

The operational software of the access system 10 may be configured to provide a plurality of options following the reception of an incorrect bar code. For example, the central processing unit 30 may permit a specified number of chances before entering a secure dormant mode where the encoding process can not be attempted for a specific period of time. The central processing unit 30 may store the incorrect entry signature within the RAM memory device 46 for retrieval at a later time. Additionally, the central processing unit 30 may be operable to enter a secure mode where access to the application apparatus 2 is not permitted. Each access system 10 in accordance with the present invention may be programmed to meet specific design concerns.

A unique signature code corresponding to an authentic key 12 is generated once the encoding mode of operation has been successfully engaged and completed by the user. More specifically, the central processing unit 30 instructs the random pulse generator 44 within the discrimination analyzer 14 to produce at least one random pulse code which corresponds to the key 12. The random pulse code may include a random series of electrical pulses which are simultaneously stored within the RAM memory device 46 and converted to an analog signal within the digital to analog converter 47.

The analog code signal may be amplified within an amplifier 48 and applied to the photon emitter 22. The photon emitter 22 emits test photons having characteristics corresponding to the random analog code signal. The test photons may be subsequently carried via the plurality of fiber optical conduits 50 through the input/output window 26. Alternatively, the test photons may be directed toward the phosphorescent composition 20 of the key 12 without the utilization of the fiber optical conduits 50. The input/output window 26 is preferably provided adjacent the fiber optical conduits 50 or the photon emitter 22.

The test photons subsequently illuminate the phosphorescent composition 20 of the key 12 placed adjacent to the input/output window 26 as shown in FIG. 2. The phosphors within the phosphorescent composition upon or in the key 12 absorb the radiation energy (test photons) and begin to re-emit the energy as response photons (possibly at different wavelengths) as the phosphors return to their ground state energy levels. In particular, the phosphorescent composition 20 subsequently emits response photons following the illumination by the test photons. The response photons pass through the input/output window 26 and are applied, via the plurality of receptor fiber optical conduits 52, or directly, to the photon receptor 24.

Figure 5:
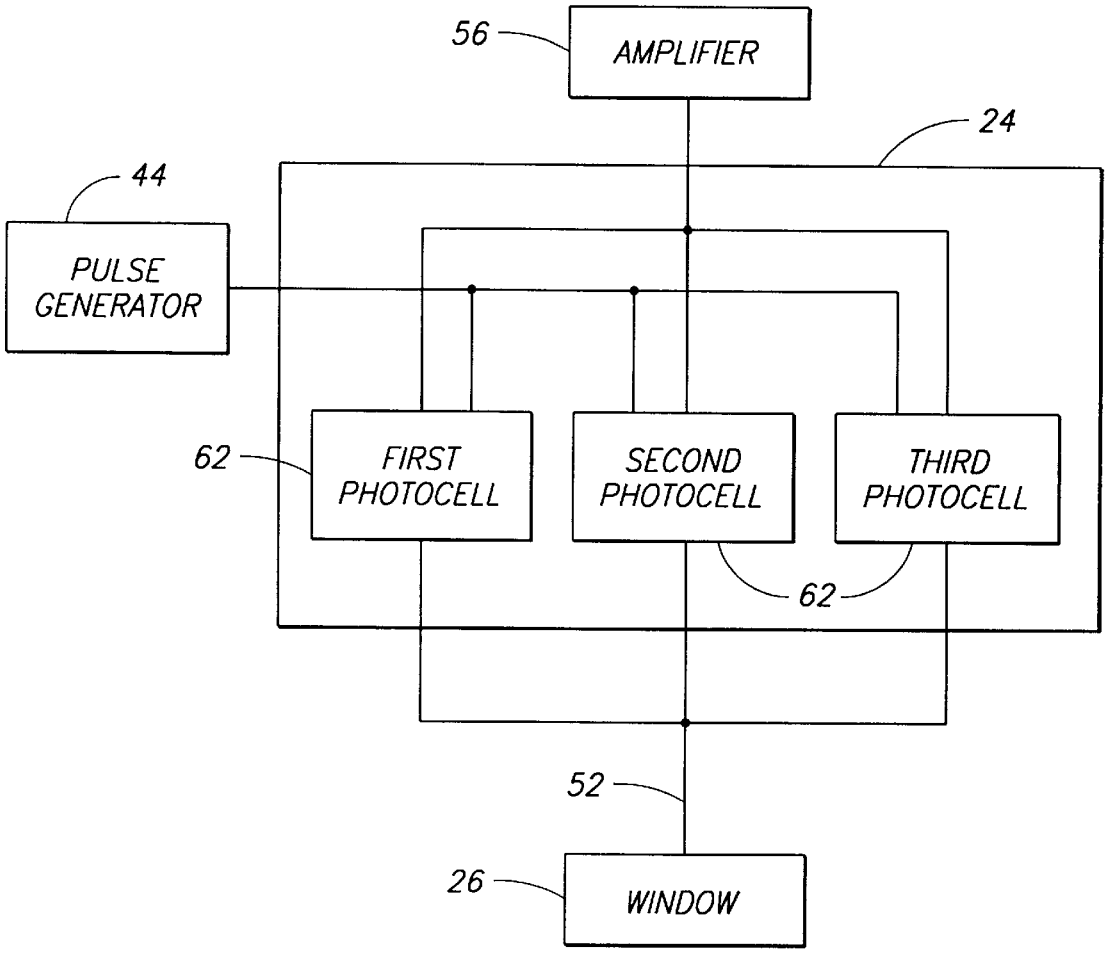
FIG. 5 is a functional block diagram of a preferred embodiment of the photon receptor within the light interface of the access system in accordance with the present invention.

The photon receptor 24 converts the re-emitted photon energy into electrical voltage signals. The conversion may be randomized to provide increased security in accordance with a preferred embodiment of the present invention. In particular, the photon receptor 24 may comprise a plurality of photocells 62 which individually cover predefined wavelengths. Referring to FIG. 5, the photocells 62 may be strobed according to the random pulse code generated via the pulse generator 44. Alternatively, the pulse generator 44 may be operative to generate a first random code for application to the photon emitter 22 and a second random code for application to the photon receptor 24. The is appropriate random code must be known to correctly sample the response photons emitted by the phosphorescent composition 20 of the key 12.

The electrical signals generated by the photon receptor 24 may be applied to an amplifier 56 for amplification and converted to a digital signal within an analog to digital converter 54. The digitized representation of the energy received via the response photons is a signature code corresponding to the key 12 placed adjacent the input/output window 26. The random pulse code or codes and corresponding signature code are stored within the RAM memory device 46 for comparison in the future. The authentic key 12 may thereafter be utilized to access an application apparatus 2 via the access system 10 according to the present invention.

Comparison Procedure

A user who wishes to access the application apparatus 2 locked by the access system 10 according to the present invention may initiate a key checking analysis via the user interface 36. The discrimination analyzer 14 preferably idles in a dormant, locked mode for power conservation when a key is not present for comparison. However, once a user presents a key, the discrimination analyzer 14 preferably switches to operational mode.

Referring to FIG. 1, the user may either request analysis of a key 12 via the user interface 36, or alternatively, the light interface 28 may automatically detect the presence of the key 12 and initiate the comparison procedure. In particular, the light interface 28 may include a key initiation sensor 6 which is configured to provide an initiation signal responsive to the presence of a key 12 for providing the access system 10 in operational mode and beginning the comparison procedure. A user may present an appropriate key 12 adjacent the input/output window 26 for comparison. The key initiation sensor 6 may comprise a motion sensor for providing automatic generation of an initiation signal. An initiation signal generated by the user interface 36 or key initiation sensor 6 may be applied to the central processing unit 30.

Responsive to the reception of an appropriate initiation signal, the central processing unit 30 retrieves the previously stored random pulse code from the RAM memory device 46. The random pulse code was preferably utilized during the encoding process to generate a corresponding signature code. The random pulse code is applied to the digital to analog converter 47 within the light interface 28. The analog representation of the random pulse code may be amplified within amplifier 48. The photon emitter 22 emits a plurality of test photons according to the random pulse code. The emitted test photons illuminate the phosphorescent composition 20 on the presented key 12 via the fiber optical conduits 50 and input/output window 26.

The phosphorescent materials present within the phosphorescent composition 20 absorb the radiation energy and subsequently emit the energy as response photons. The response photons pass through the input/output window 26 and are directed toward the receptor fiber optical conduits 52.

The entire surface area of the phosphorescent composition 20 preferably has the same photon absorption and emission characteristics. This homogeneity of the phosphorescent composition 20 on each key 12 assures acceptance of any portion of the phosphorescent composition 20 placed over the input/output window 20.

The emission of test photons and response photons occurs at such a high rate of speed that the effect of the particular motion of the key 12 over the input/output window 26 is eliminated. Accordingly, failures to read the key 12 are drastically reduced or eliminated in contrast with the operation of conventional bar code reading devices.

The receptor fiber optical conduits 52 may direct the response photons to the photon receptor 24 which converts the photon energy into an electrical representative signal. The representative signal is amplified within amplifier 56 and applied to the analog to digital converter 54 providing a digitized representative signal of the presented key 12.

Referring again to FIG. 5 the photocells 62 may be individually strobed according to the random pulse code stored within the RAM memory device 46. Each photocell 62 may cover a respective wavelength which may overlap the wavelength covered by an adjacent photocell 62. The strobing of the individual photocells 62 according to the stored random pulse code creates an additional level of encoding which must be known to operate the access system 10 according to the present invention. Randomizing the emission of test photons and the reception of the response test photons increases the security afforded by the access system 10 in accordance with the preferred embodiment of the present invention.

Figure 4:
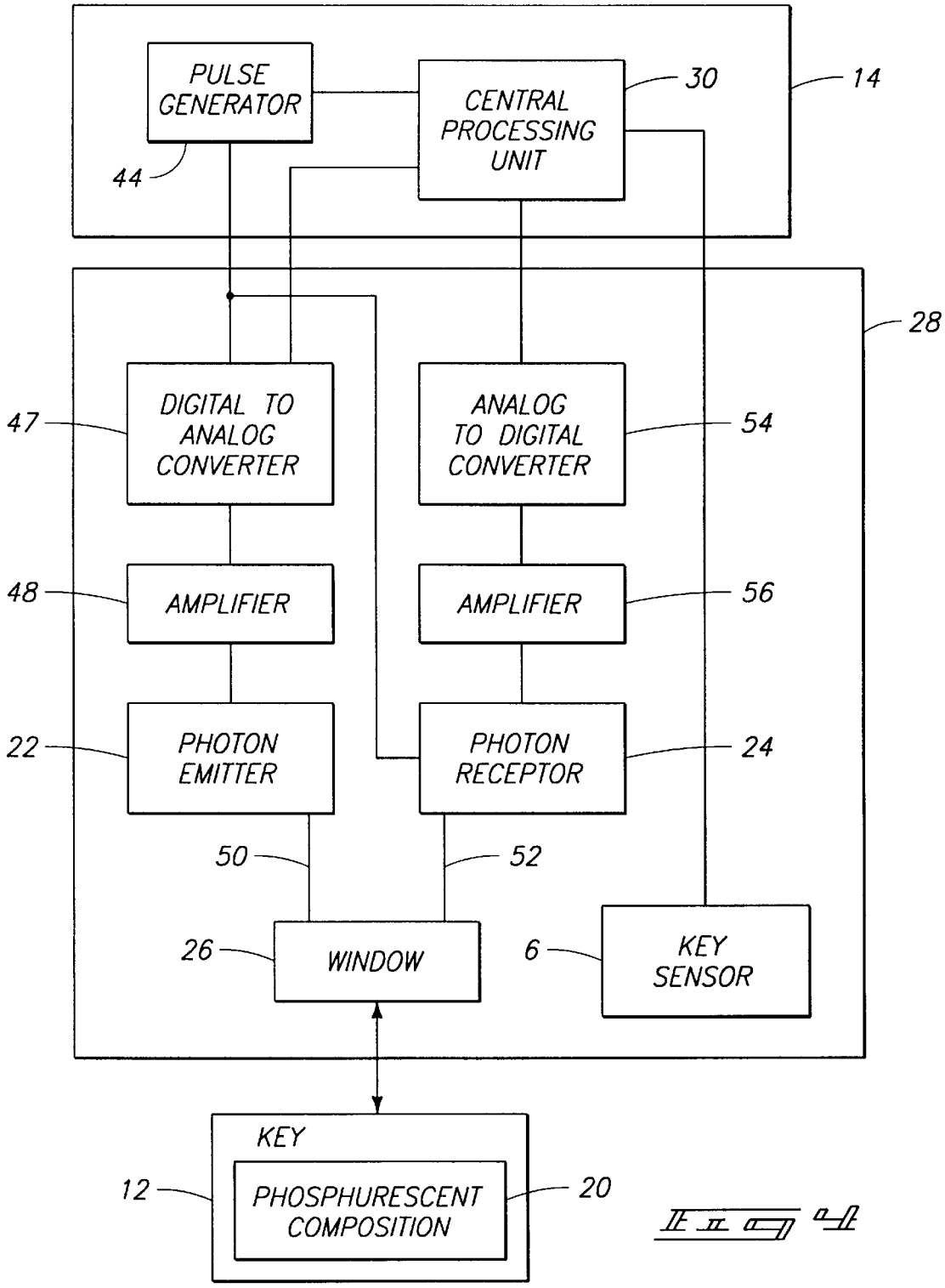
FIG. 4 is a functional block diagram of a light interface in accordance with a preferred embodiment of the present access system.

Referring to FIG. 4, the representative signal may be applied to the central processing unit 30. The central processing unit 30 compares the received representative signal from the most recently presented key 12 with the signature code or codes stored within the RAM memory device 46. The central processing unit 30 may issue a control signal to a lock actuator 60 following a determination thereby that a match of the signature code and representative signal exists in accordance with predefined standards. Preferably, the signature code and representative signal are analyzed to assess the degree to which they match one another. The signature code and representative signal need not be identical matches of one another. The level or range of allowed mismatch can be tailored to assure function during adverse conditions while maintaining an appropriately high rejection rate of false or counterfeit keys. The indication of a match of the signature code and the representative signal by the access system 10 (through the generation of a control signal) is nearly instantaneous with the presentation of a key 12.

Referring to FIG. 2, the lock actuator 60 may comprise a solenoid, relay or other electromechanical device for operating a lock coupled with an application apparatus 2. Additionally, the lock actuator 60 may provide supply power, or a control signal by fiber optic link or other conduit, to the application apparatus 2 (computer or other electrical system) following the matching of the signature code with the representative signal of an authentic key 12.

Access to the application apparatus 2 is not permitted following a determination by the central processing unit 30 that the representative signal from the presented key 12 does not acceptably match the stored signature code. The central processing unit 30 may be configured to store the failed attempt in the RAM memory device 46 for further reference. In addition, the access system 10 may enter a secure mode following a predetermined number of failed attempts to unlock the access system 10. The access system 10 may not be "unlocked" under any condition for a predetermined length of time once the access system 10 enters the secure mode.

In another embodiment of the present invention, a plurality of authentic keys 12 may be utilized to "unlock" the access system 10. In particular, individual signature codes may be generated for a plurality of keys 12 via respective ones of a plurality of random pulse codes. Each of the individual signature codes may be stored within the RAM memory device 46 for comparison at a time in the future. Access may be permitted if one of the authentic keys 12 is presented and matched with a signature code.

It is to be distinctly understood that the access system 10 in accordance with the present invention may be utilized in a variety of applications and those set forth explicitly herein are exemplary only. There are a variety of alternate methods, circuits, and coding procedures that can result in the same functionality. The applications herein do not constitute the only methods covered by the claim of originality and uniqueness.

The attachments and sensors to which the access system 10 is connected may vary with the specific application apparatus 2 being secured. For example, if the access system 10 were connected to a gun, the safety might be utilized to trigger the comparison procedure. If the access system 10 were installed on construction equipment to prevent unauthorized use, the key sensor 6 might be connected to the ignition switch, and the device would disable the operation of the machine in the absence of an appropriate key 12.

The applicability and flexibility of the concepts of the access system 10 according to the present invention invite a wide range of alternative installation variables. These include, but are not limited to, providing more than one encoded authentic key 12, more than one authentic key needed for recognitions an alarm that sounds, or dials a phone alert when more than a predetermined number of attempts to access the application apparatus 2 are unsuccessful (an indication that an unauthorized attempt at activation is in progress).

The phosphorescent composition 20 of the key 12 may include a plurality of specific phosphorescent materials (from thousands that could be compounded) each with a clearly different emission characteristic in either or both wavelength and half life. An embodiment of the key 12 may be composed of 8 of these compounds and a matrix binder that is essentially transparent to the wavelengths used. Numerous combinations of 8 ingredients from an initial set of (for this example) 100 phosphorescent materials may be utilized.

In addition, the phosphorescent composition 20 may be varied quantatively as well as qualitatively. The percentage of each material within the phosphorescent composition 20 could be the same (i.e., 12.5% of each of 8 randomly selected phosphorescent materials). Alternatively, varied percentages of the respective phosphorescent materials within the phosphorescent composition 20 could be utilized. Altering the percentages of the phosphorescent materials within a single phosphorescent composition 20 provides an increased security measure.

Example

The access system 10 in accordance with the present invention may be installed on the latch of a gate (not shown). A security guard approaching the gate may trigger a motion or key sensor 6 that initiates the signature code comparison process of the access system 10 in accordance with the present invention. The guard places his/her gloved hand on the gate handle. The key 12 may be implemented on the back of the fingers of the glove on the hand of the guard. The guard may place the key 12 against the phosphorescent sensing zone (e.g., input/output window 26 implemented on the gate handle). If the representative signal generated by the presence of the key 12 matches a signature code, the access system 10 allows the handle to operate the latch with no apparent time delay. The gate handle remains locked if there is no match of the representative signal generated by the key 12 on the guard's glove with the signature codes previously stored in the RAM memory device 46.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An access system operable to identify an authentic key, the access system comprising:

a photon emitter configured to emit at least one test photon;

a key having at least one phosphorescent material, the at least one phosphorescent material being operable to emit at least one response photon responsive to the reception of the at least one test photon;

a photon receptor coupled with the key and comprising a plurality of photocells configured to receive response photons having different wavelengths and to generate representative signals thereof; and a discrimination analyzer coupled with the photon receptor, the discrimination analyzer being operable to generate a security code to control strobing of the photocells to implement photon reception of the photon receptor, and generate a control signal responsive to a comparison of the representative signal and a signature code.

2. The access system according to claim 1 wherein the discrimination analyzer includes a pulse generator configured to generate the security code.

3. The access system according to claim 1 wherein the discrimination analyzer applies the security code to the photon emitter and the photon receptor.

4. The access system according to claim 3 wherein the discrimination analyzer includes a pulse generator configured to generate and apply the security code to the photon emitter to control the emission of the at least one test photon.

5. The access system according to claim 1 further comprising a memory device operable to store the signature code and the corresponding security code.

6. The access system according to claim 1 wherein the at least one phosphorescent material includes a plurality of phosphorescent materials.

7. The access system according to claim 1 wherein the signature code is generated by sampling response photons emitted from the key.

8. The access system according to claim 1 wherein the discrimination analyzer is configured to generate the security code to control the photocells to individually receive response photons only having one predefined wavelength.

9. The access system according to claim 1 further comprising a lock actuator coupled with the discrimination analyzer, the lock actuator being configured to operate a lock responsive to the control signal.

10. A method of identifying an authentic key, the method comprising the steps of:

providing a key having at least one phosphorescent material;

first emitting at least one test photon second emitting at least one response photon using the key and responsive to the at least one test photon;

receiving the at least one response photon using a photon receptor comprising a plurality of photocells configured to receive response photons having different wavelengths;

generating a security code to control strobing of the photocells to implement the receiving using the photon receptor;

generating a representative signal corresponding to the at least one response photon;

comparing the representative signal with a signature code; and generating a control signal responsive to the comparison of the representative signal and the signature code.

11. The method according to claim 10 wherein the generating the security code comprises generating to control the photocells to individually receive response photons only having one predefined wavelength.

12. The method according to claim 10 further comprising the step of applying the control signal to a lock actuator for operating a lock.

13. The method according to claim 10 wherein the generating the security code comprises generating a random security code to control the first emitting and the receiving.

14. The method according to claim 10 wherein the generating the security code comprises generating at least one security code to control the first emitting and the receiving.

15. The method according to claim 14 wherein the generating the security code comprises generating a random security code.

16. The method according to claim 10 further comprising the step of generating a signature code.

17. The method according to claim 10 further comprising the step of storing the signature code.

18. A method of identifying an authentic key, the method comprising the steps of:

generating a signature code corresponding to the authentic key;

storing the signature code;

providing a key having at least one phosphorescent material thereon;

first emitting a plurality of test photons;

second emitting a plurality of response photons using the key and responsive to the emission of the test photons;

receiving the response photons using a plurality of photocells configured to receive response photons having different wavelengths;

generating a security code to control strobing of the photocells to implement the receiving;

generating a representative signal corresponding to the response photons following the receiving;

comparing the representative signal with the signature code; and generating a control signal responsive to the comparison of the representative signal and the signature code.

19. The method according to claim 18 wherein the generating the security code comprises generating a random security code.

20. The method according to claim 18 wherein the generating the security code comprises generating at least one security code to control the first emitting and the receiving.

21. The method according to claim 18 wherein the control signal indicates the presence of the authentic key.

22. The method according to claim 18 further comprising the step of applying the control signal to a lock actuator for operating a lock.

* * * * *